US009830874B2

(12) United States Patent
Kuo et al.

(10) Patent No.: US 9,830,874 B2
(45) Date of Patent: Nov. 28, 2017

(54) ELECTRONIC DEVICE HAVING SMALLER NUMBER OF DRIVE CHIPS

(71) Applicant: SHENZHEN CHINA STAR OPTOELECTRONICS TECHNOLOGY CO., LTD., Shenzhen, Guangdong (CN)

(72) Inventors: Ping-Sheng Kuo, Guangdong (CN); Tai-Jiun Hwang, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/777,208

(22) PCT Filed: Jun. 27, 2014

(86) PCT No.: PCT/CN2014/080960
§ 371 (c)(1),
(2) Date: Oct. 1, 2015

(87) PCT Pub. No.: WO2015/188406
PCT Pub. Date: Dec. 17, 2015

(65) Prior Publication Data

US 2017/0186392 A1 Jun. 29, 2017

(30) Foreign Application Priority Data

Jun. 13, 2014 (CN) ..... 2014 1 0265151

(51) Int. Cl.
*G09G 3/36* (2006.01)

(52) U.S. Cl.
CPC ..... *G09G 3/3674* (2013.01); *G09G 3/3685* (2013.01); *G09G 3/3611* (2013.01)

(58) Field of Classification Search
CPC ... G09G 3/3674; G09G 3/3685; G09G 3/3611
See application file for complete search history.

(56) References Cited

U.S. PATENT DOCUMENTS 5,200,741 A 4/1993 Usui
2002/0080108 A1* 6/2002 Wang ..... G09G 3/3677 345/90

(Continued)

FOREIGN PATENT DOCUMENTS

CN 1635567 A 7/2005
CN 101022004 A 8/2007

(Continued)

OTHER PUBLICATIONS

Ran Ding, the International Searching Authority written comments, dated Mar. 2015, CN.

*Primary Examiner* — Premal Patel

(57) ABSTRACT

The present invention provides an electronic device (100) having smaller number of drive chips and including a timing controller (10), a gate and a source drive chips (20, 30), a pixel cells matrix (60) and a multiplexer (40). The multiplexer (40) includes a plurality of first signal outputs connected to the pixel cells matrix (60). The timing controller (10) might generate enable signals for the multiplexer (40). In this way, the multiplexer (40) could output scan signals to the pixel cells matrix by a corresponding signal end. The number of the drive chips could be reduced by the present invention.

9 Claims, 6 Drawing Sheets

(56) References Cited

U.S. PATENT DOCUMENTS

| | | | | |
|---|---|---|---|---|
| 2012/0075280 | A1* | 3/2012 | Liu | G09G 3/3677 345/212 |
| 2012/0147018 | A1* | 6/2012 | Liu | G06F 13/14 345/520 |
| 2012/0223927 | A1* | 9/2012 | Hsieh | G09G 3/36 345/211 |

FOREIGN PATENT DOCUMENTS

| | | | |
|---|---|---|---|
| CN | 101145318 | A | 3/2008 |
| CN | 101222224 | A | 7/2008 |
| CN | 102054456 | A | 5/2011 |
| CN | 102165511 | A | 8/2011 |
| CN | 102915709 | A | 2/2013 |
| EP | 0755044 | A1 | 1/1997 |
| JP | 2007178524 | A | 7/2007 |
| JP | 2007199347 | A | 8/2007 |

* cited by examiner

ELECTRONIC DEVICE HAVING SMALLER NUMBER OF DRIVE CHIPS

FIELD OF THE INVENTION

The present invention relates to electronic devices, and more particularly to electronic devices with display function.

BACKGROUND OF THE INVENTION

At present, LCD (liquid crystal display) monitors and other display devices are already very common. Due to the need for large-size screen, one of development trends of the LCD display devices is large-scale. However, the number of gate drive chips and source drive chips required are also greatly increased in such size-enlarged screens, which could result in increased cost.

SUMMARY OF THE INVENTION

An object of the present invention is to provide an electronic device having smaller number of drive chips to drive large-size screens.

The present invention provides an electronic device having smaller number of drive chips, the electronic device comprises a timing controller, a gate drive chip, a source drive chip and a pixel cells matrix; the gate drive chip comprises at least one drive signal output end to generate scanning drive signals. The pixel cells matrix comprises several pixel cells distributing in a matrix. Wherein the electronic device further comprises: at least one multiplexer, each multiplexer comprises a signal input end, a plurality of signal output ends and a plurality of enable ends. Wherein the signal input end is connected to the driver signal output end corresponding to the gate drive chip to receive scanning drive signals generated by the driver signal output end corresponding to the gate drive chip, the signal output ends are connected respectively to a plurality of rows of pixel cells in the pixel cells matrix; wherein the timing controller are electrically connected to the enable ends of the multiplexer for sequentially sending enable signals thereto; the multiplexer might output scanning signals to the pixel cells matrix by a corresponding signal output end to control the scan of the corresponding row of pixel cells when one of the first enable end receives an enable signal.

Wherein, the timing controller comprises a plurality of enable signal output ends, each of which is connected respectively to the enable ends to control the enable signal output end to output enable signals to the enable ends of the multiplexer.

Wherein, the electronic device further comprises a level shifter, which is connected between the enable signal output ends of the timing controller and the enable ends of the multiplexer to output each boosted enable signal of the enable signal output of the timing controller to the corresponding enable end of the multiplexer.

Wherein, the multiplexer comprises a plurality of path selecting circuits, each of which comprises a first NMOS and a first boost inverter; the first boost inverter comprises an input end and an output end, a source of the first NMOS is connected to a corresponding signal input end of the multiplexer, a drain of the first NMOS is connected to a corresponding signal output end of the multiplexer, and its gate is connected to an output end of the first boost inverter, an input end of the first boost inverter is connected to a corresponding enable end of the multiplexer. The first boost inverter might output signals of the corresponding enable end after inverting them.

Wherein, the multiplexer further comprises a first voltage terminal and a second voltage terminal. The electronic device further comprises a power supply, the first voltage terminals and the second voltage terminals of the first and the second multiplexers are connected to the power supply and thus to receive respectively high voltages and low voltages; the path selecting circuit further comprises a second NMOS and a second boost inverter, and the second boost inverter comprises an input end and an output end; a source of the second NMOS is connected to the second voltage terminal of the multiplexer, its drain is connected to a corresponding signal output end of the multiplexer, and its gate is connected to an output end of the second boost inverter, an input end of the second boost inverter is connected to the output end of the first boost inverter and the gate of the first NMOS.

Wherein, enable signals generated by the timing controller are high-level signals. The first NMOS of the path selecting switch of a corresponding enable end connected with the multiplexer would be conducted when a high-level enable signal is generated by the timing controller and then send to one of the enable ends of the multiplexer, such that the signal output end of the path selecting switch output corresponding scanning drive signals or display drive signals.

Wherein, the first boost inverter and the second boost inverter each comprise a third NMOS, a fourth NMOS, a fifth NMOS and a capacitor; a gate of the third NMOS is connected to the input end, its source is connected to the second voltage terminal of the multiplexer, and its drain is connected to a source of the fourth NMOS and the output end; a drain of the fourth NMOS is connected to the first voltage terminal of the multiplexer, its gate is connected to a source of the fifth NMOS; a gate and a drain of the fifth NMOS are connected each other and are connected to the first voltage terminal of the multiplexer, the source of the fifth NMOS is also connected to one end of the capacitor, another end of the capacitor is connected to the output end.

Wherein, the electronic device further comprises an array substrate, the multiplexer and the pixel cells matrix are mounted thereon, and the gate drive chip, the source drive chip, the timing controller and the level shifter are all mounted outside thereof.

Wherein, the electronic device further comprises an array substrate, the multiplexer and the pixel cells matrix and the level shifter are mounted thereon, and the gate drive chip, the source drive chip and the timing controller are all mounted outside thereof.

Wherein, the electronic device further comprises a shift register which only comprises an enable signal output end to output enable signals, the level shifter is connected to the enable signal output end to boost the enable signal output thereof; the shift register is connected between the level shifter and enable ends of the multiplexer to sequentially apply the boosted enable signals by the level shifter onto the enable ends of the multiplexer.

Wherein, the electronic device further comprises an array substrate, the multiplexer, the pixel cells matrix, the level shifter and the shift register are all mounted thereon.

Wherein, the electronic device might be a LCD TV, a LCD monitor, a mobile phone, a tablet or a notebook.

The electronic device of the present invention has smaller number of drive chips and could scan and drive large-size screens driven by smaller number of gate drive chips.

DETAILED DESCRIPTION OF THE PREFERRED EMBODIMENTS

Figure 1:
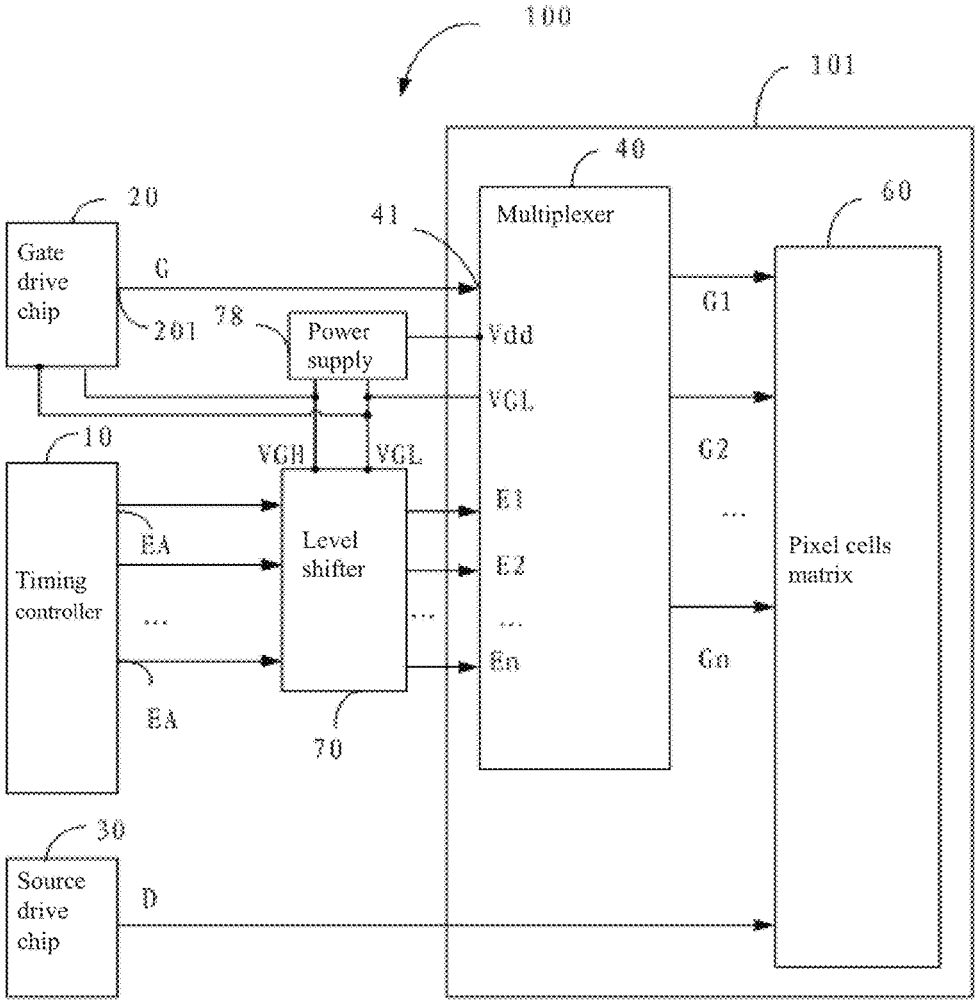
FIG. 1 is a schematic diagram of an electronic device having smaller number of drive chips according to a first embodiment of the invention.

Please refer to FIG. 1, which is a schematic diagram of an electronic device having smaller number of drive chips. The electronic device includes a timing controller 10, a gate drive chip 20, a source drive chip 30 and at least one multiplexer 40 and a pixel cells matrix 60.

Wherein the gate drive chip 20 includes at least one drive signal output end 201 to generate scanning drive signals G. The source drive chip 30 could generate display drive signals D. The number of the source drive chip 30 of the present invention is 1 to generate display drive signals D for the pixel cells matrix 60.

Each multiplexer 40 includes a signal input end 41 and a plurality of signal output ends G1~Gn. Wherein the signal input end 41 of the multiplexer 40 is connected to the driver signal output end 201 corresponding to the gate drive chip 20 to receive scanning drive signals G generated by the driver signal output end 201 corresponding to the gate drive chip 20. The number of the multiplexer 40 is equal to that of the driver signal output end 201 of the gate drive chip 20.

The multiplexer 40 also includes a plurality of enable ends E1~En. The timing controller 10 is electrically connected to the enable ends E1~En of the multiplexer 40 to sequentially send enable signals thereto. In this way, the enable ends E1~En of the multiplexer 40 might sequentially receive the enable signals.

The pixel cells matrix 60 includes several pixel cells distributing in a matrix (not shown). The signal output ends G1~Gn of the multiplexer 40 are respectively connected to several rows of pixel cells in the pixel cells matrix 60. The multiplexer 40 might output scanning signals G to the pixel cells matrix 60 by the signal output ends G1~Gn to control the scan of the corresponding row of pixel cells when one of the first enable end E1~En receives an enable signal.

Thereby, in the present invention, the number of the drive signal output ends 201 of the gate drive chip 20 could be reduced, that is the number of channels of the gate drive chip 20 could be reduced, thus to scan and drive the pixel cells matrix 60.

Wherein, the FIG. 1 illustrates only one drive signal output ends 201 of the gate drive chip 20. Obviously, the number of the drive signal output ends 201 could more than 1. The multiplexer 40 is multiple when the drive signal output ends 201 of the gate drive chip 20 is multiple, and each multiplexer 40 is connected to the corresponding output end 201 to perform the functions described by the present invention.

Wherein, when the number of the drive signal output ends 201 of the gate drive chip 20 and the multiplexer 40 is 1, the number of the signal output ends G1~Gn of the multiplexer 40 is equal to the maximum number of rows of the pixel cells matrix 60. When the number of the drive signal output ends 201 of the gate drive chip 20 and the multiplexer 40 is more than 1, the number of all the signal output ends G1~Gn of the plurality of multiplexers 40 is equal to the maximum number of rows of the pixel cells matrix 60.

Wherein, as shown in the FIG. 1, in the first embodiment of the present invention, the timing controller 10 includes a plurality of enable signal output ends EA. Each enable signal output end EA of the timing controller 10 is connected respectively to the enable ends E1~En of the multiplexer 40 to control the enable signal output end EA to output enable signals to the enable ends E1~En of the multiplexer 40.

Wherein, as shown in the FIG. 1, in the present embodiment, the electronic device 100 also includes a level shifter 70. The level shifter 70 is connected between the enable signal output ends EA of the timing controller 10 and the enable ends E1~En of the multiplexer 40 to output each boosted enable signal of the enable signal output EA of the timing controller 10 to the corresponding enable end of the multiplexer 40.

Wherein, the multiplexer 40 includes a plurality of path selecting circuits, each of which comprises a first NMOS and a first boost inverter; the first boost inverter comprises an input end and an output end, a source of the first NMOS is connected to a corresponding signal input end of the multiplexer, a drain of the first NMOS is connected to a corresponding signal output end of the multiplexer, and its gate is connected to an output end of the first boost inverter, an input end of the first boost inverter is connected to a corresponding enable end of the multiplexer. The first boost inverter might output signals of the corresponding enable end after inverting them.

Wherein, the multiplexer 40 also includes a first voltage terminal Vdd and a second voltage terminal VGL. The electronic device 100 also includes a power supply 78, the power supply 78 is connected respectively to the first voltage terminal Vdd and the second voltage terminal VGL of the multiplexer 40. The power supply 78 is also connected to the level shifter 70 and the gate drive chip 20 to supply operating voltages thereto. Wherein, in the present embodiment, the operating voltages supplied to the level shifter 70 and the gate drive chip 20 by the power supply 78 are respectively a third voltage VHG and a second voltage VGL. In the present embodiment, the first voltage Vdd supplied to the first voltage terminal VHG and the third voltage VHG are all high level voltages, and the second voltage supplied second voltage terminal VGL is a ground voltage, i.e., low level voltage.

The power supply 78 might be a battery, a positive electrode and a negative electrode of which are connected respectively to the first voltage terminal VHG and the second voltage terminal VGL of the multiplexer 40 to supply respectively a high level voltage and a low level voltage thereto. In other embodiment, the power supply 78 might be a voltage converter having several output ports to supply respectively first, second and third voltage.

Figure 2:
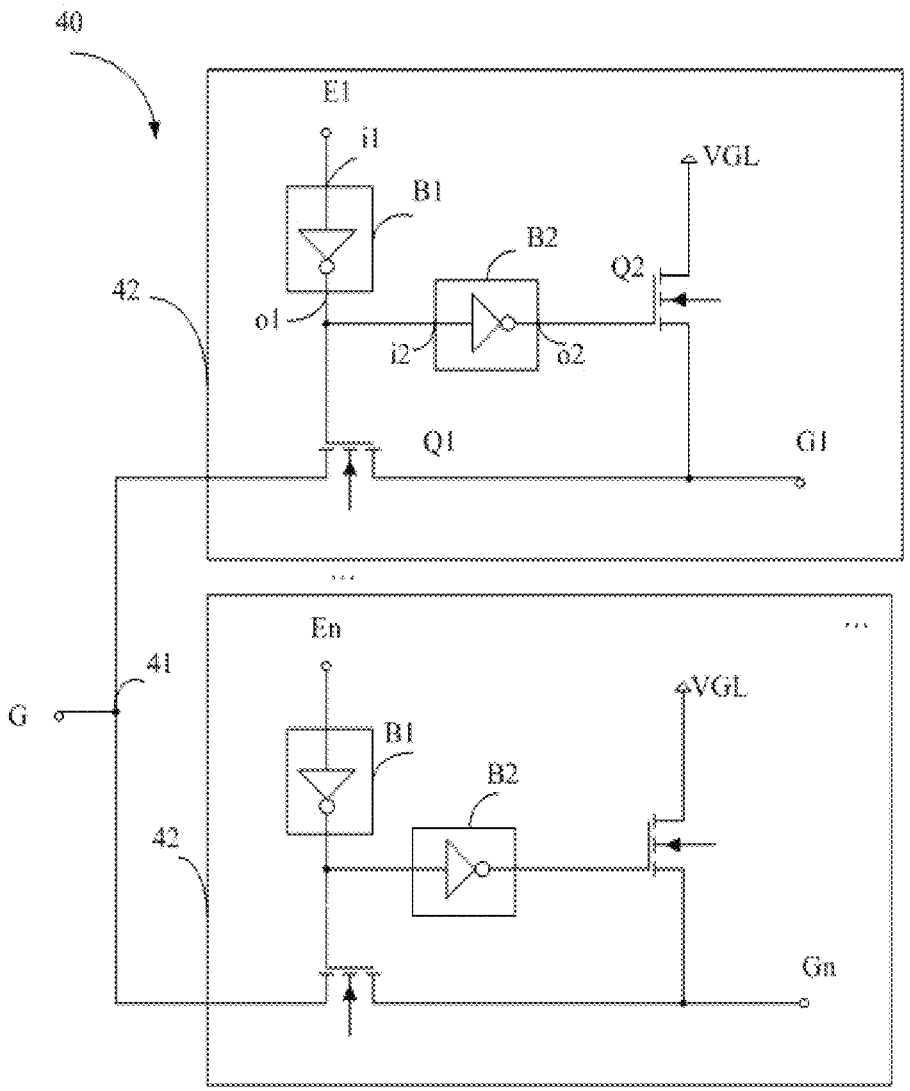
FIG. 2 is a specific circuit diagram of a multiplexer of the electronic device having smaller number of drive chips according to an embodiment of the invention.

Please refer to FIG. 2, which is a internal configuration of the multiplexer 40. Wherein, the multiplexer 40 includes a plurality of path selecting circuits 42, each of which includes a first NMOS Q1 and a first boost inverter B1. The first boost inverter B1 includes an input end i1 and an output end o1. A source of the first NMOS Q1 is connected to a signal input end 41, a drain of the first NMOS Q1 is connected to a corresponding signal output end, and its gate is connected to an output end o1 of the first boost inverter B1, an input end it of the first boost inverter B1 is connected to a corresponding enable end. The first boost inverter B1 might output signals of the corresponding enable end after inverting them.

In the present embodiment, the enable signals generated by the timing controller 10 are low-level signals. Therefore, the first NMOS Q1 would be conducted by receiving a high-level signal that is inverted from a low-level enable signal by the first boost inverter B1 of the path selecting switch 42 corresponding an enable end when the low-level enable signal is generated by the timing controller 10 and then send to one of the enable ends E1~En of the multiplexer 40, such that the signal output end of the path selecting switch 42 output one of the scanning drive signals G1~Gn.

Wherein, as shown in the FIG. 2, the path selecting switch 42 also includes a second NMOS Q2 and a second boost inverter B2. The second boost inverter B2 includes an input end i2 and an output end o2. A source of the second NMOS Q2 is connected to the second voltage terminal VGL of the multiplexer 40, its drain is connected to a signal output end, and its gate is connected to the output end o2 of the second boost inverter B2. The input end i2 of the second boost inverter B2 is connected to the output end o1 of the first boost inverter B1 and the gate of the first NMOS Q1. Wherein, when the timing controller 10 generates a low-level enable signal, the first boost inverter B1 might invert the low-level enable signal and output a high-level enable signal, the high-level enable signal might be inverted again by the second boost inverter B2 and a generated low-level signal is then output to the gate of the NMOS Q2, thus to cut off the NMOS Q2, without affecting the output of the output signal end connected with the path selecting switch 42.

Figure 3:
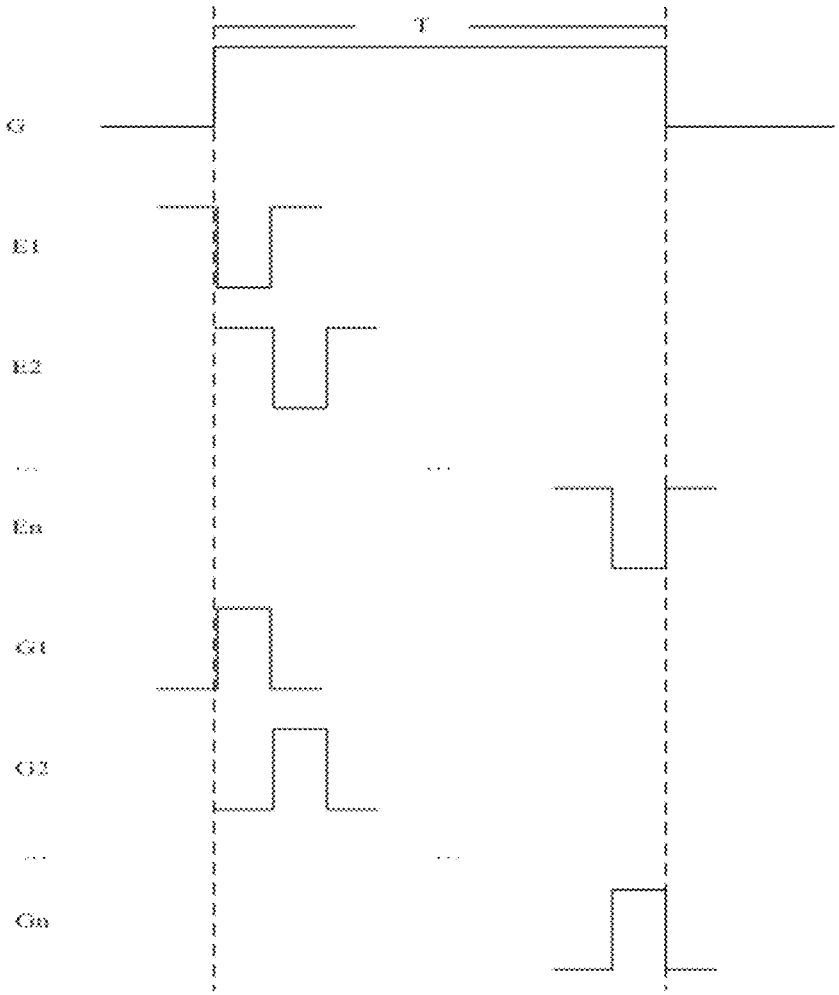
FIG. 3 is a timing chart of input and output signals of the multiplexer according to an embodiment of the invention.

Please refer to FIG. 3, which is a timing chart of input and output signals of the multiplexer 40 of the present invention. Wherein, the gate drive chip 20 could continuously generate high level scanning drive signals G within scan time T of one frame picture, the timing controller 10 sequentially generates low-level enable signals which would be sent to the enable ends E1~En of the multiplexer 40, so as mentioned above, the signal output ends connected with the path selecting switches 42 of the multiplexer 40 would sequentially output high-level scanning drive signals G1~Gn.

Figure 4:
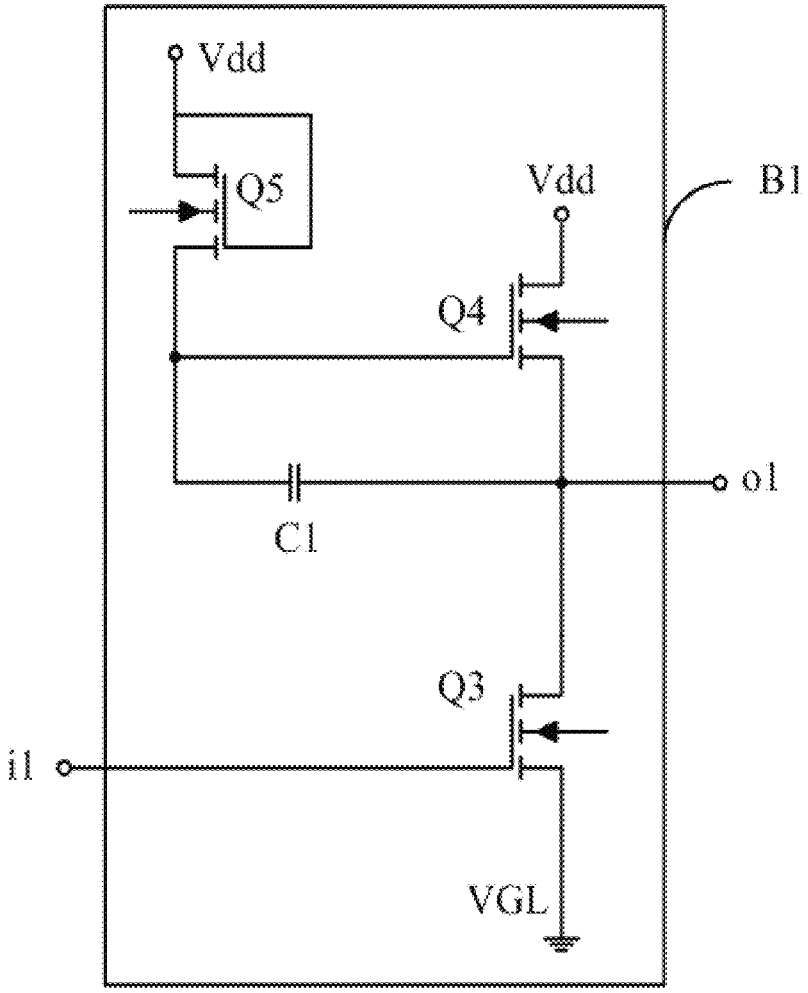
FIG. 4 is a specific circuit diagram of a boost inverter of the multiplexer according to an embodiment of the invention.

Please refer in conjunction to FIG. 4, which is an internal structure of the boost inverter of the present invention. Wherein, the first boost inverter B1 is identical to the second boost inverter B2 in each path selecting switches 42, therefore, only the first boost inverter B1 will be described as an example herein.

The first boost inverter B1 includes a third NMOS Q3, a fourth NMOS Q4, a fifth NMOS Q5 and a capacitor C1. A gate of the third NMOS Q3 is connected to the input end i1, its source is connected to the second voltage terminal VGL, and its drain is connected to a source of the fourth NMOS Q4 and the output end o1. A drain of the fourth NMOS Q4 is connected to the first voltage terminal Vdd, its gate is connected to a source of the fifth NMOS Q5. A gate and a drain of the fifth NMOS Q5 are connected each other and are connected to the first voltage terminal Vdd. The source of the fifth NMOS Q5 is also connected to one end of the capacitor C1, another end of the capacitor C1 is connected to the output end o1. Wherein the first voltage terminal Vdd has a value of 5V or other positive values.

When there are no low-level enable signals output from the enable end to the input end i1, the third NMOS Q3 might be conducted, so that the output end o1 of the first boost inverter B1 could be grounded and at a low level via the conducted third NMOS Q3, so as not to output scanning drive signals. At this time, the fourth NMOS Q4 and the fifth NMOS Q5 are conducted, and the first voltage terminal Vdd could charge the capacitor C1 via the fifth NMOS Q5.

When there are low-level enable signals output from the corresponding enable end to the input end i1, the third NMOS Q3 might be cut off, in this case, the stray capacitance on the output end o1 might be charged by the fourth NMOS Q4, and the level of the gate of the fourth NMOS Q4 might be simultaneously raised to a voltage that is higher than Vdd by coupling the output end o1 and the capacitor C1, thus to increase the driving force of the fourth NMOS transistor Q4. At this moment, the output end o1 could output high-level scanning drive signals.

In the present embodiment, the value of the first voltage Vdd supplied to the first boost inverter B1 and the second boost inverter B2 of the multiplexer 40 might be higher than the third voltage VGH supplied to the level shifter 70 and the gate drive chip 20, in this way, the first NMOS Q1 and the second NMOS Q2 could operate in a linear region (high current and fast charge and discharge), so the first NMOS Q1 and the second NMOS Q2 could achieve sufficient charge and discharge capacity with smaller sizes.

In the present embodiment, as shown in the FIG. 1, the electronic device 100 also includes an array substrate 101, and the multiplexer 40 and the pixel cells matrix 60 are mounted thereon in the first embodiment of the present invention, and the gate drive chip 10, the source drive chip 20, the timing controller 10 and the level shifter 70 are all mounted outside thereof.

Figure 5:
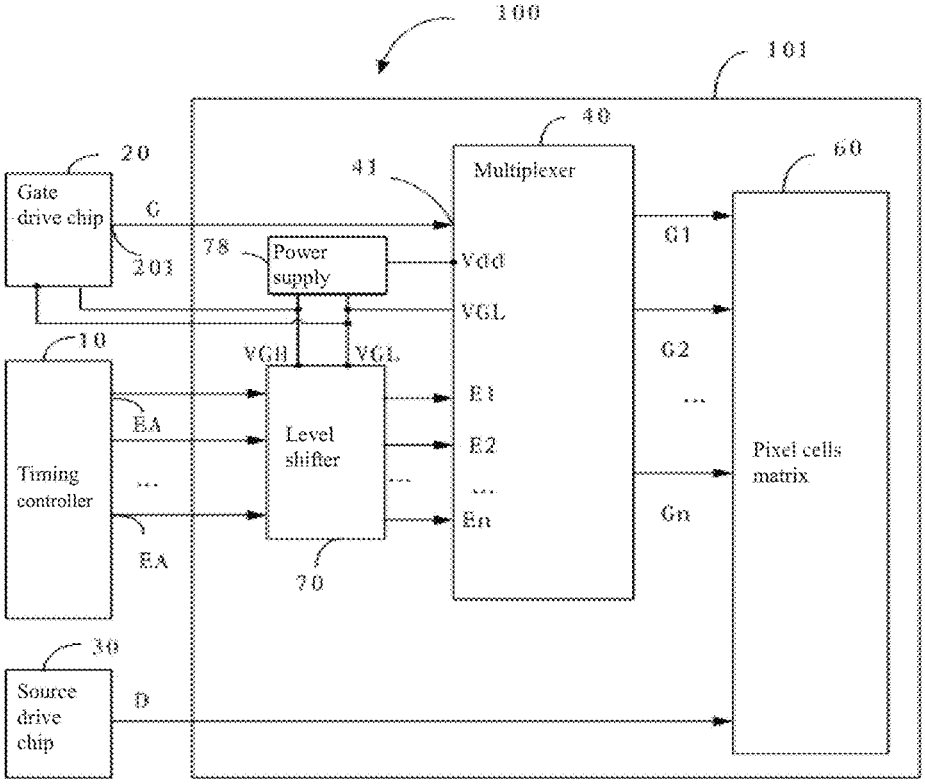
FIG. 5 is a schematic diagram of an electronic device having smaller number of drive chips according to a second embodiment of the invention.

Please refer to FIG. 5, in the second embodiment, the multiplexer 40 and the pixel cells matrix 60 and the level shifter 70 are all mounted on the array substrate 101.

Figure 6:
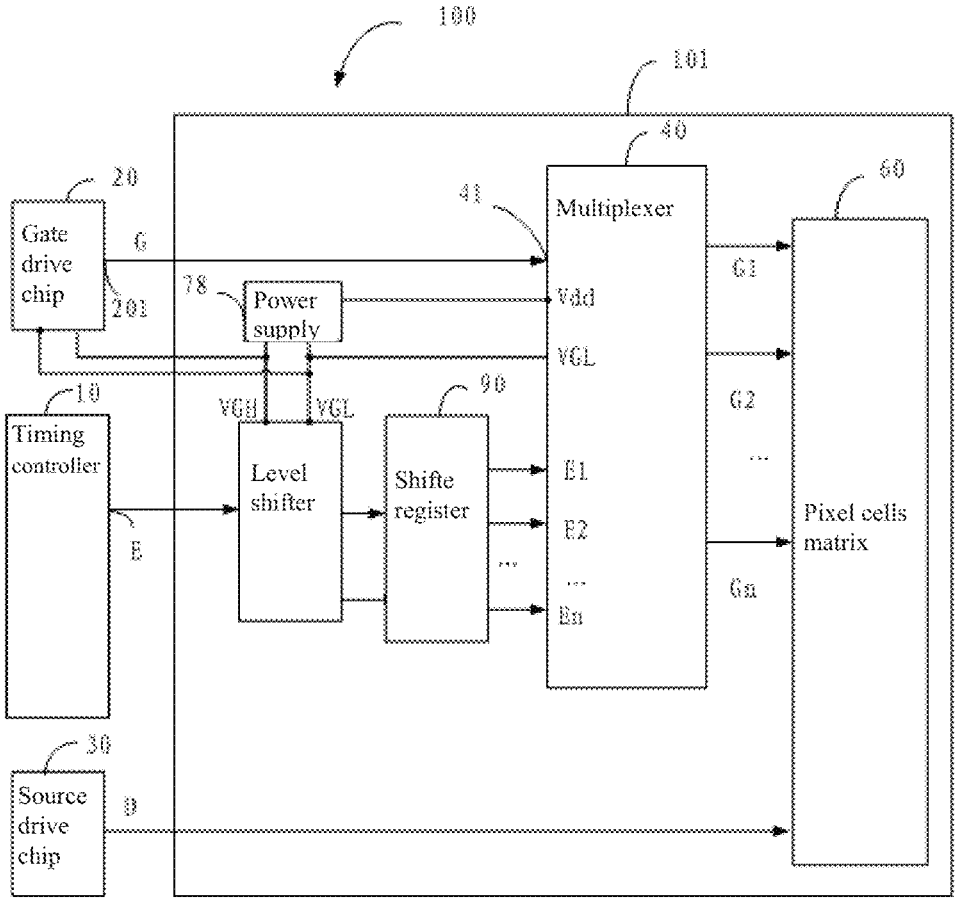
FIG. 6 is a schematic diagram of an electronic device having smaller number of drive chips according to a third embodiment of the invention.

Please refer to FIG. 6, in the third embodiment, the electronic device 100 also includes a shift register 90. In the present embodiment, the timing controller 10 only includes an enable signal output end E to output enable signals. The level shifter 70 is connected to the enable signal output end E to boost the enable signal output thereof. The shift register 90 is connected between the level shifter 70 and enable ends E1~En of the multiplexer 40 to sequentially apply the boosted enable signals by the level shifter 70 onto the enable ends E1~En of the multiplexer 40. In this way, the enable ends E1~En of the multiplexer 40 could sequentially receive the enable signals and sequentially output the scanning signals by the signal output ends G1~Gn.

Wherein, in the third embodiment, the multiplexer 40, the pixel cells matrix 60, the level shifter 70 and the shift register 90 are all mounted on the array substrate 101.

Wherein, the electronic device 100 might be a LCD TV, a LCD monitor, a mobile phone, a tablet or a notebook, etc.

Therefore, the electronic device 100 of the present invention could be scanned and driven by only one gate drive chip 20 and one multiplexer, so as to induce the number of the gate drive chips and save the cost.

Although this invention has certain preferred embodiment, but they could not limit the present invention. The scope of the present invention is not limited to the above-described embodiment, it will be obvious to those skilled in the art that various changes and modifications may be made therein without departing from the invention, and all such changes and modifications are intended to fall within the true spirit and scope of the invention that defined in the claims.

What is claimed is:

1. An electronic device having smaller number of drive chips, comprising a timing controller, a gate drive chip, a source drive chip and a pixel cells matrix; said gate drive chip comprises at least one drive signal output end to generate scanning drive signals, the pixel cells matrix comprises several pixel cells distributing in a matrix, wherein said electronic device further comprises:

at least one multiplexer, each multiplexer comprises a signal input end, a plurality of signal output ends and a plurality of enable ends, wherein said signal input end is connected to said driver signal output end corresponding to said gate drive chip to receive scanning drive signals generated by said driver signal output end corresponding to said gate drive chip, said signal output ends are connected respectively to a plurality of rows of pixel cells in the pixel cells matrix;

wherein said timing controller are electrically connected to said enable ends of said multiplexer for sequentially sending enable signals thereto; said multiplexer is capable of outputting scanning signals to said pixel cells matrix by a corresponding signal output end to control the scan of said corresponding row of pixel cells when one of said first enable end receives an enable signal, wherein said electronic device further comprises a level shifter, which is connected between enable signal output ends of the timing controller and the enable ends of the multiplexer to output each boosted enable signal of the enable signal output of the timing controller to the corresponding enable end of the multiplexer;

wherein said multiplexer comprises a plurality of path selecting circuits, each of which comprises a first NMOS and a first boost inverter; the first boost inverter comprises an input end and an output end, a source of the first NMOS is connected to a corresponding signal input end of the multiplexer, a drain of the first NMOS is connected to a corresponding signal output end of the multiplexer, and its gate is connected to an output end of the first boost inverter, an input end of the first boost inverter is connected to a corresponding enable end of the multiplexer, the first boost inverter is capable of outputting signals of the corresponding enable end after inverting them.

2. The electronic device according to claim 1, wherein said multiplexer further comprises a first voltage terminal and a second voltage terminal; the electronic device further comprises a power supply, the first voltage terminals and the second voltage terminals of the first and the second multiplexers are connected to the power supply and thus to receive respectively high voltages and low voltages; the path selecting circuit further comprises a second NMOS and a second boost inverter, and the second boost inverter comprises an input end and an output end; a source of the second NMOS is connected to the second voltage terminal of the multiplexer, its drain is connected to a corresponding signal output end of the multiplexer, and its gate is connected to an output end of the second boost inverter, an input end of the second boost inverter is connected to the output end of the first boost inverter and the gate of the first NMOS.

3. The electronic, device according to claim 2, wherein said first boost inverter and the second boost inverter each comprise a third NMOS, a fourth NMOS, a fifth NMOS and a capacitor; a gate of the third NMOS is connected to the input end, its source is connected to the second voltage terminal of the multiplexer, and its drain is connected to a source of the fourth NMOS and the output end; a drain of the fourth NMOS is connected to the first voltage terminal of the multiplexer, its gate is connected to a source of the fifth NMOS; a gate and a drain of the fifth NMOS are connected each other and are connected to the first voltage terminal of the multiplexer, the source of the fifth NMOS is also connected to one end of the capacitor, another end of the capacitor is connected to the output end.

4. The electronic device according to claim 1, wherein said enable signals generated by the timing controller are high-level signals, the first NMOS of the path selecting switch of a corresponding enable end connected with the multiplexer would be conducted when a high-level enable signal is generated by the timing controller and then send to one of the enable ends of the multiplexer, such that the signal output end of the path selecting switch output corresponding scanning drive signals or display drive signals.

5. The electronic device according to claim 1, wherein said electronic device further comprises an array substrate, the multiplexer and the pixel cells matrix are mounted thereon, and the gate drive chip, the source chive chip, the timing controller and the level shifter are all mounted outside thereof.

6. The electronic device according to claim 1, wherein said electronic device further comprises an array substrate, the multiplexer and the pixel cells matrix and the level shifter are mounted thereon, and the gate drive chip, the source drive chip and the timing controller are all mounted outside thereof.

7. The electronic device according to claim 1, wherein said electronic device further comprises a shift register which only comprises an enable signal output end to output enable signals, the level shifter is connected to the enable signal output end to boost the enable signal output thereof; the shift register is connected between the level shifter and enable ends of the multiplexer to sequentially apply the boosted enable signals by the level shifter onto the enable ends of the multiplexer.

8. The electronic device according to claim 7, wherein said electronic device further comprises an array substrate, the multiplexer, the pixel cells matrix, the level shifter and the shift register are all mounted thereon.

9. The electronic device according to claim 7, wherein said electronic device is a LCD TV, a LCD monitor, a mobile phone, a tablet or a notebook.

* * * * *